United States Patent [19]

Porter et al.

[11] Patent Number: 4,941,535

[45] Date of Patent: Jul. 17, 1990

[54] MANUAL PORT CLOSING TOOL FOR WELL CEMENTING

[75] Inventors: Gary L. Porter; William B. Cade, both of Hobbs, N. Mex.

[73] Assignee: Texaco Inc., White Plains, N.Y.

[21] Appl. No.: 297,214

[22] Filed: Jan. 17, 1989

Related U.S. Application Data

[62] Division of Ser. No. 258,929, Oct. 17, 1988, Pat. No. 4,850,432.

[51] Int. Cl.[5] ..... E21B 33/14

[52] U.S. Cl. ..... 166/285; 166/169; 166/373; 166/386

[58] Field of Search ..... 166/289, 373, 376, 386, 166/332, 153, 154, 155, 156, 166, 169, 285, 381

[56] References Cited

U.S. PATENT DOCUMENTS

| | | | |
|---|---|---|---|
| 3,223,160 | 12/1965 | Baker | 166/289 |
| 3,768,556 | 10/1973 | Baker | 166/154 |
| 3,811,500 | 5/1974 | Morrisett et al. | 166/153 |
| 4,260,017 | 4/1981 | Nelson et al. | 166/289 |
| 4,421,165 | 12/1983 | Szarka | 166/289 |
| 4,669,541 | 6/1987 | Bissonnette | 166/154 |
| 4,674,569 | 6/1987 | Revils et al. | 166/289 |

*Primary Examiner*—Jerome W. Massie
*Assistant Examiner*—Terry Lee Melius
*Attorney, Agent, or Firm*—Robert A. Kulason; James J. O'Loughlin; Robert B. Burns

[57] ABSTRACT

In a downhole staging apparatus for delivering fluidized cement sequentially into two levels of substrate which enclose a wellbore casing. Said apparatus comprises a primary cement discharge port, and one or more secondary or lateral cement discharge ports. A sleeve is operably carried in the apparatus, being adjustable to close the secondary lateral port when a cementing operation is completed. A sleeve actuating tool is cooperative with said cementing apparatus, being remotely operable to close the lateral cement discharge port to assure that no communication exists between the cementing apparatus and the wellbore after the cementing operation is completed.

3 Claims, 4 Drawing Sheets

MANUAL PORT CLOSING TOOL FOR WELL CEMENTING

This is a division of application Ser. No. 07/258,929, filed 10/17/88, now U.S. Pat. No. 4,850,432.

BACKGROUND OF THE INVENTION

The method and apparatus here disclosed is addressed in general to stage cementing, and is related particularly to means for dispensing or injecting fluidized cement under pressure, into vertically spaced apart levels of a substrate which surrounds the casing of a hydrocarbon producing well. The apparatus includes a cement dispensing head, also identified as a staging collar, having a casing which is adapted at one end to communicate by a pipe string, to a source of the fluidized cement. The injected cement will form a continuous sheath about the casing exterior.

The dispensing head or staging collar includes a casing having a central chamber or passage with an opening at the lower end for discharging fluidized cement during a first cementing stage, into a first level of the substrate. One or more secondary, or lateral openings formed in the casing wall subsequently conduct cement during a second stage, into a second level of the substrate.

In a stage collar of the type contemplated, a plug or closure member carried into the casing on the downward flow of fluidized cement, engages an annular seat at the casing lower end thereby interrupting the downward cement flow and terminating first stage flow. Resulting back pressure actuates a flow control member to open the secondary discharge ports and divert the cement flow therethrough.

After the initial cementing stage, a multi-segment sleeve operably registered in the casing central chamber is displaced from a retracted position to a forward position Functionally, in the forward position the sleeve segment closes the lateral cement discharge ports and discontinues cement flow therethrough at the end of the second stage.

A first segment of the flow control sleeve in the stage collar includes an annular shoulder which will sealably engage a flow carried opening plug, thereby to preclude further cement flow therethrough during the first stage. A second segment of the flow control sleeve includes a second annular seal which engages a second wiper plug to discontinue cement flow.

In the event the cement flow regulating sleeve becomes inoperable to control cement flow as a result of improper action of the wiper plug, or for other reasons, means is known to forcefully adjust or displace the sleeve section into closing position. In any instance, it is necessary to actuate the flow control sleeve in a manner to assure that the casing lateral discharge openings are closed to cement flow.

STATEMENT OF THE INVENTION

In accordance with the invention, a flow control sleeve actuating tool as herein described. The tool is cooperative with the cement staging collar, to rotatably drill its way through set cement contained in the casing as the tool descends. As the tool progresses downward it will first cut away at least a part of the upper sleeve sealing shoulders. The tool will thereafter engage the composite sleeve upper segment to urge said segment into the desired displaced or closed position. Closing of the lateral cement discharge ports will segregate the casing interior chamber or central passage from the wellbore.

OBJECTS OF THE INVENTION

It is an object of the invention therefore to provide a manually operated well cementing apparatus capable of being remotely controlled to sequentially inject the substrate of a wellbore with fluidized cement at spaced apart levels.

A still further object is to provide a tool which is capable of overcoming an operational defect in a stage collar or cement dispensing apparatus, to facilitate proper injection of cement and the subsequent pressure testing of the well.

DESCRIPTION OF THE DRAWINGS

Referring to FIG. 1, a wellbore 10 of the ty,pe generally contemplated is formed in a substrate 11 which surrounds a cased well 15. A cement mixing apparatus 12 is shown at the surface 17 during a cementing operation. Said apparatus includes a pump which is capable of providing a pressurized flow of the fluidized cement by way of conductor 23, down the well to form an enclosing sheath 9 about the well casing.

Figure 1:
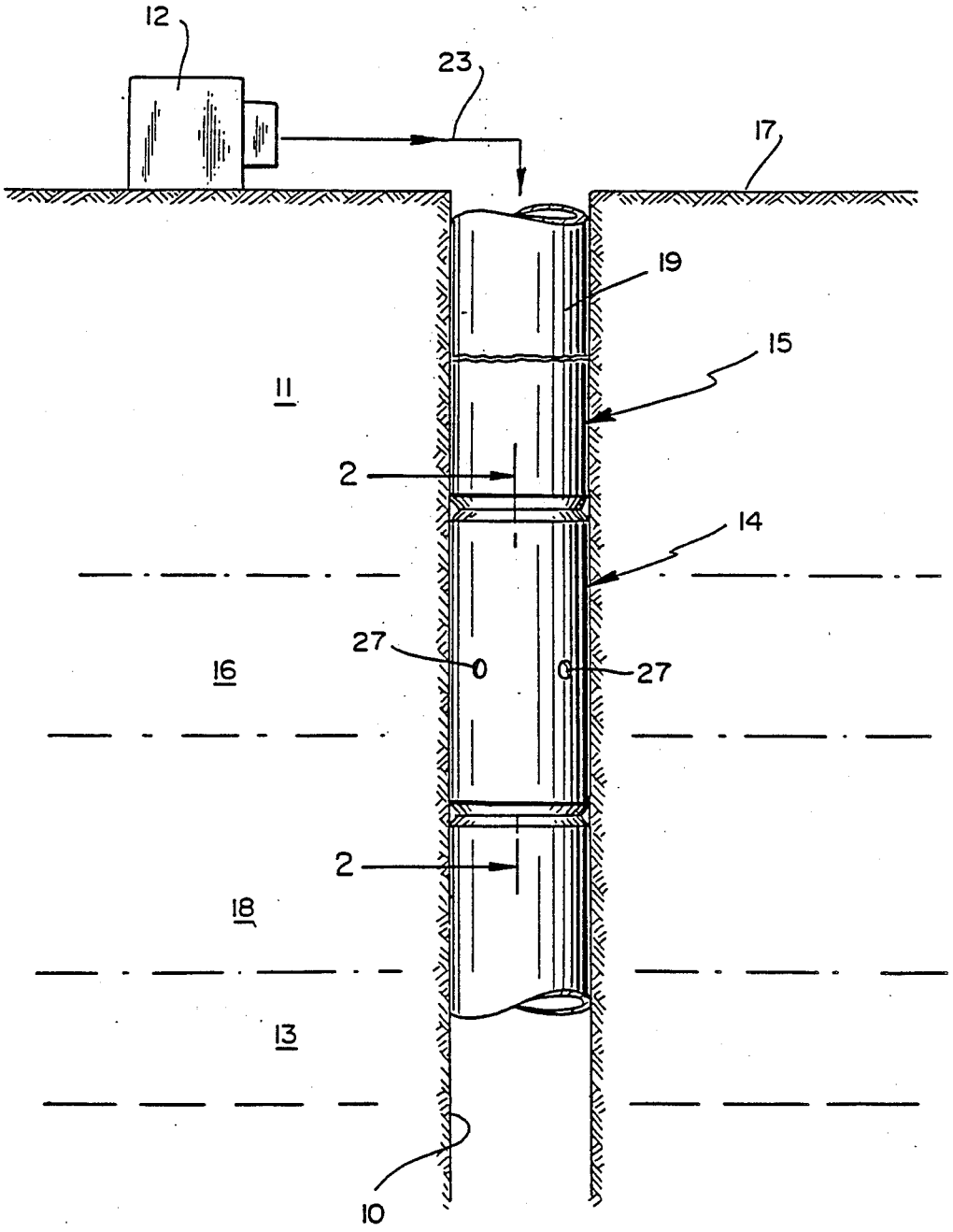
FIG. 1 is an environmental view of a well which has been enclosed in a cement sheath.

Wellbore 10 is preferably aligned in a general vertical orientation although being diverted at an angle into the substrate would not constitute a detriment to operation of the invention. Wellbore 10 as shown, is normally formed in substrate 11 to communicate with several hydrocarbon productive levels. Such an arrangement will serve to maximize hydrocarbon production.

To illustrate the invention, one level 13 to be cemented is at the lower end of the prepositioned cement dispensing head or stage collar 14 which is incorporated into the casing string 19. The upper level 16 to be cemented is located such that an intermediate space or area of interest 18 will be defined between the two cemented levels.

The downhole cement dispensing head or stage collar 14 is communicated to the surface positioned mixing apparatus 12 by a pipe or casing string 19 and conductor 25. In the latter, the cement mix is put into fluidized condition prior to being pumped into the well.

Figure 2:
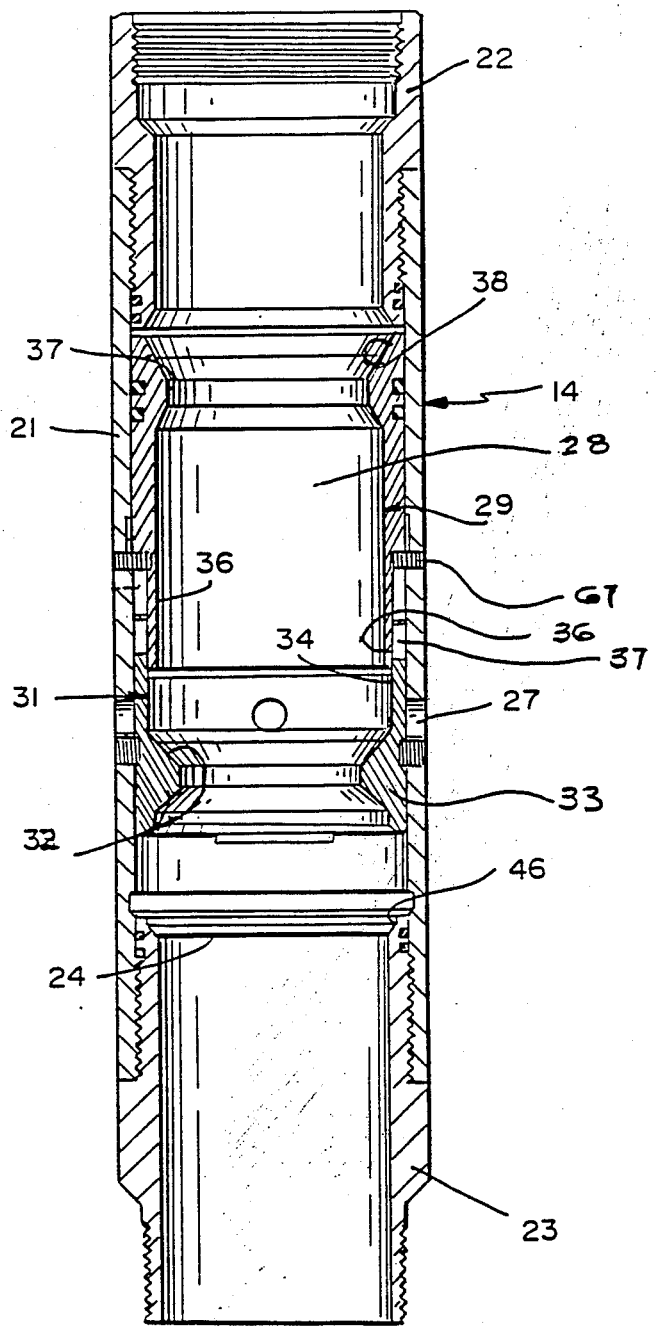
FIG. 2 is an enlarged cross-sectional view taken along line 2—2 in FIG. 1.

Referring to FIG. 2, the downhole stage collar or cement dispensing head 14, referred to hereinafter as a stage collar, includes an elongated casing 21 normally formed of a heavy steel pipe or tubing. Casing 21 is structured to withstand expected elevated operating pressures as well as abrasive action of cement being pumped therethrough.

Casing or shell 21 is comprised of an elongated cylindrical body which defines an interval chamber 28. The upper end of said casing section is provided with a coupling for removable engagement to a casing member 22. A threaded recess engages the end of a pipe string segment 19 or the like for carrying fluidized cement from the surface.

The lower end of cylindrical casing 21 can be provided with further casing lengths, which will reach several thousand feet into the wellbore.

Casing 21 is further provided with one or more periplherally arranged lateral discharge ports 27. The latter are formed through the casing 21 wall and communicate with central chamber 28. Said ports 27 can comprise a single opening through the casing wall. They preferably comprise a plurality of such openings equispaced about the casing wall to discharge cement flows in a particular direction or pattern.

Casing 21 encloses a composite, internal flow control sleeve comprised of an upper or first segment 29, and a second or lower segment 31. Upper sleeve segment 29 is slidably positioned against the casing 21 internal wall and is longitudinally movable through chamber 28. Lower sleeve segment 31 is separable from upper sleeve segment 29, and includes an annular shoulder 32, one side of which defines a first annular sealing surface.

Shoulder 32 projects inwardly toward the central chamber 28 to form a constricted opening. A rearwardly extending tail section 34 of lower segment 31 is formed to slidably register with a corresponding skirt 36 at the adjacent edge of the sleeve upper segment 29.

Operationally, lower sleeve segment 31 is longitudinally movable through passage or chamber 28 between a first position when the tail section 34 defines a closure across the lateral discharge ports 27, to a displaced position away from said ports 27.

As shown in FIG. 2, when the composite sleeve lower segment 31 is urged into the downward position, lateral cement discharge ports 27 will be open, and in communication with chamber 28 to allow a flow of fluidized cement therethrough. The latter will enter the substrate, flow downwardly against the casing outer wall, and progressively build up to a sheath-like coating 9.

Upper sleeve segment 29 is comprised of an elongated cylindrical section having downwardly extending skirt 36. The latter, as noted, defines a cylindrical annular space 37 into which the tail section 34 of lower sleeve segment 31 is registered. Sleeve segment 29 upper end is provided with an inwardly projecting shoulder 37 which defines a second annular sealing seat, or contact surface 38. Prior to being displaced, the respective sleeve segments are held in position by shear pins or small, shearable screws 67.

Prior to being forcefully displaced, upper sleeve segment 31 is retained in place as noted by a shear pin or small fastener. The latter will be sheared to release sleeve segment 29, by hydraulic pressure.

Figure 4:
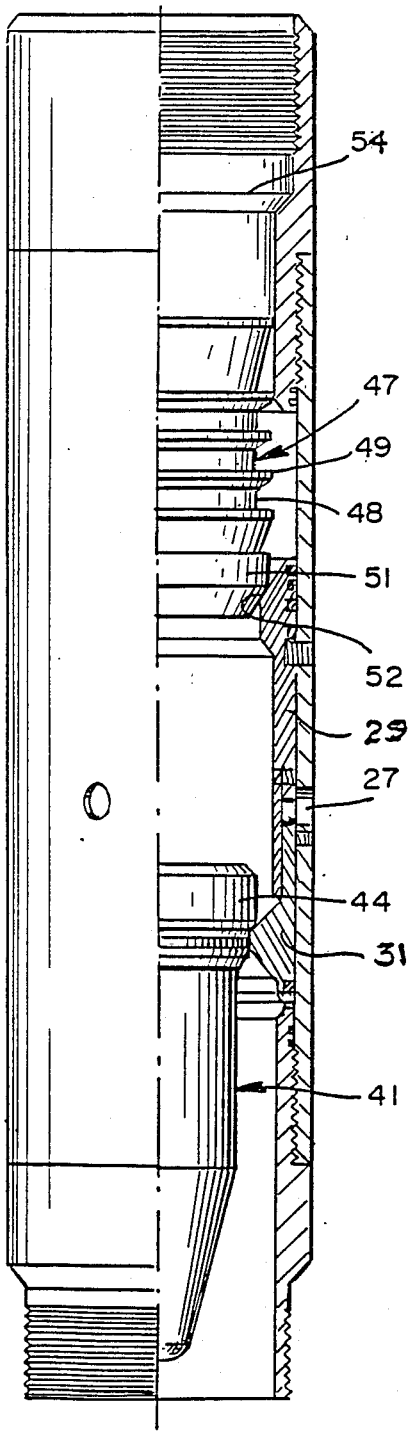

Upper sleeve segment 29 is movable between a retracted position as shown in FIG. 2, to a forward position as shown in FIG. 4. In the forward position, skirt 36 is lowered to contact tail section 34 thereby effecting a closure across the one or more lateral discharge ports 27.

Figure 3:
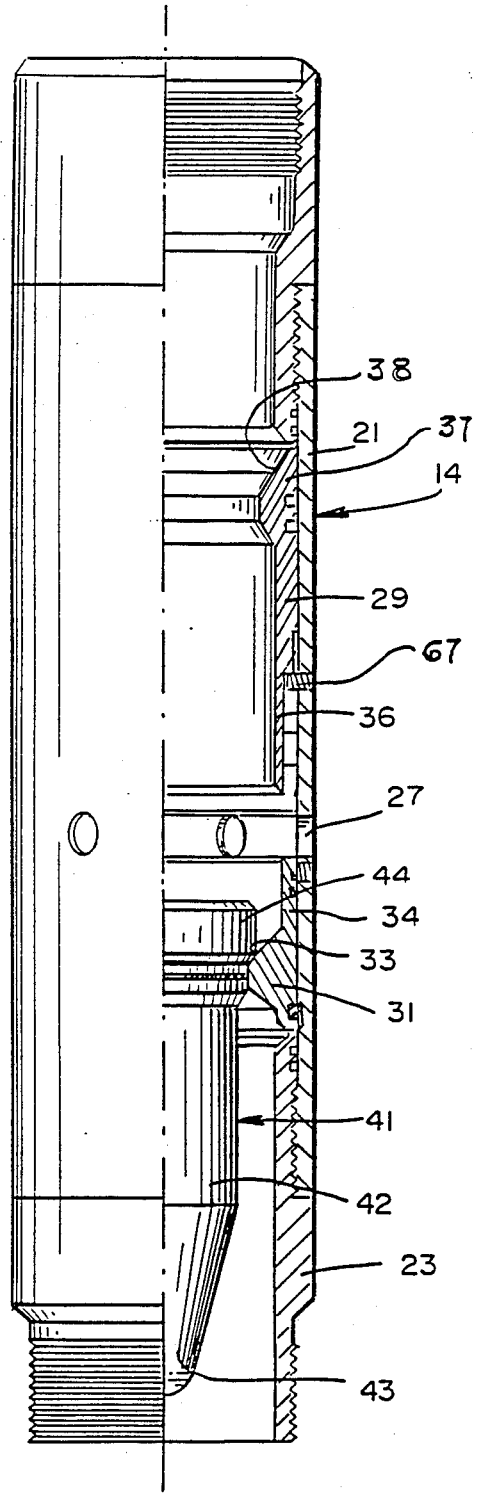
FIGS. 3 and 4 are similar to FIG. 2.

Operationally, and as shown in FIG. 3, after a sufficient, usually predetermined volume of cement has been injected into lower substrate level 13 from stage collar 14, plug 41 is inserted into the fluidized cement stream. Plug 41 is thereby conveyed down through pipe string 19, and into central passage 28.

Plug 41 includes basically a cylindrical body 42 having a forward tapered nose 43 and a rearward positioned hub 44. The latter is of a sufficient diameter to pass through upper sleeve segment 29, and includes an outer contact surface. Hub 44, upon entering shoulder 33 will continue downwardly until the plug registers in the lower end of the stage collar. Thus, as contact is made between the annular shoulder 33 and hub 44, lower sleeve segment 31 will be displaced downwardly until it abuts lip 46 of the pipe string. The hub underside sealably engages the sealing face 33 of first annular shoulder 32.

Concurrently, displacement of lower sleeve segment 31 will open the one or more lateral discharge ports 27. As mentioned herein, this movement will allow fluidized cement to be diverted, and be forced through ports 27 and into the adjacent substrate level 16.

After a period, during which a predetermined amount of cement has been deposited into the substrate 16 by way of the secondary discharge ports 27, normal operating procedure is to insert a closing wiper plug 47 into the fluidized cement stream. In one embodiment, wiper plug 47 includes basically a body 48 having a plurality of wiper ridges 49 which extend outwardly therefrom. A face section 51 of the wiper plug includes a tapered, frusto conical surface 52 which corresponds to the sealing surface of shoulder 37. The body 48 is provided with wiper ridge sections 53 which contact the casing inner surface against which the cement flow will pass.

As wiper plug 47 is carried downwardly through pipe string 19, it will be urged forward in response to cement pressure against wiper rear face 54. As said closing wiper plug 47 enters casing 21, contact face 52 will engage the corresponding surface of annular shoulder 38. Downward pressure of the cement stream will thereby urge the upper sleeve segment 29 from its retracted position, into a forward position. In the latter skirt 36 will register about the corresponding tail piece 34 of lower sleeve segment 31.

Normally, at this point of the procedure, the cementing stages will be completed and the well will be in condition for pressure testing. The latter is carried out to assure lack of communication between the stage collar central chamber 28 and substrate adjacent thereto.

In some instances, the above described closing action of wiper plug 47 is unsuccessful in displacing sleeve segment 29 to its forward position to form a closure across the lateral cement discharge openings 27. In such an instance, one corrective procedure is to squeeze the cement, to exert sufficient pressure to form a closure at the secondary discharge port 27.

To overcome such a situation, wherein the closing of the lateral cement port 27 cannot be readily effectuated, there is presently provided an actuating tool 56 of a size to be lowered through pipe string 9 and enter the stage collar. The primary function of this member is to move sleeve segment 29 into its actuated, cooperating position with the lower sleeve segment 31.

Figure 5:
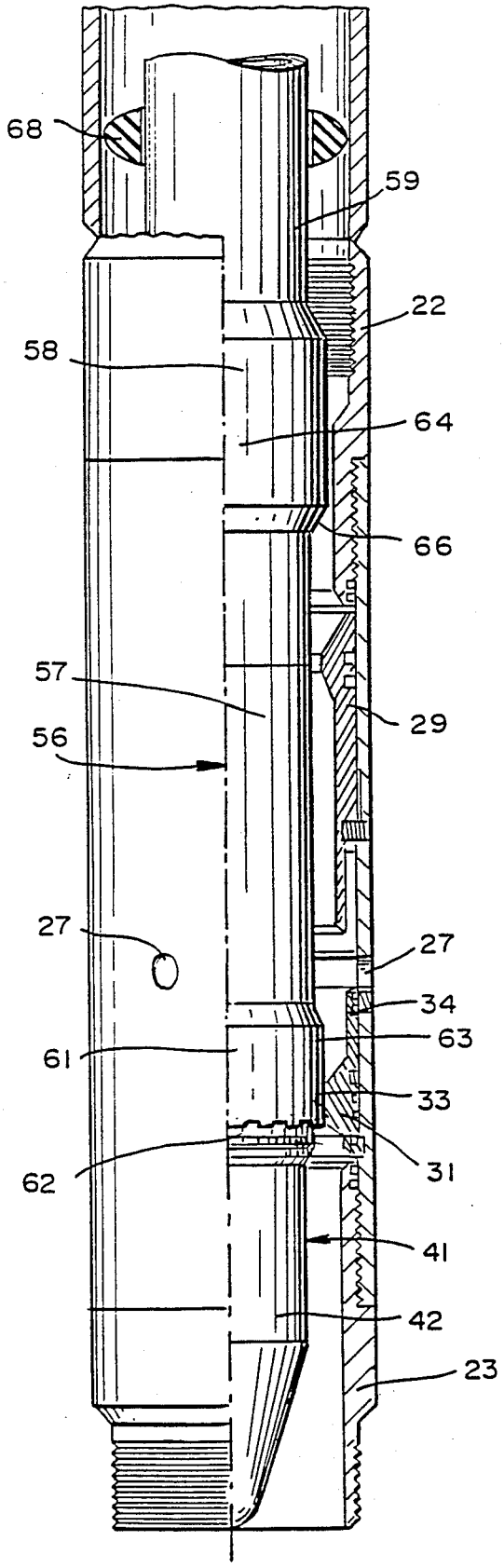
FIG. 5 illustrates the novel actuating tool in place within a stage collar.
Figure 6:
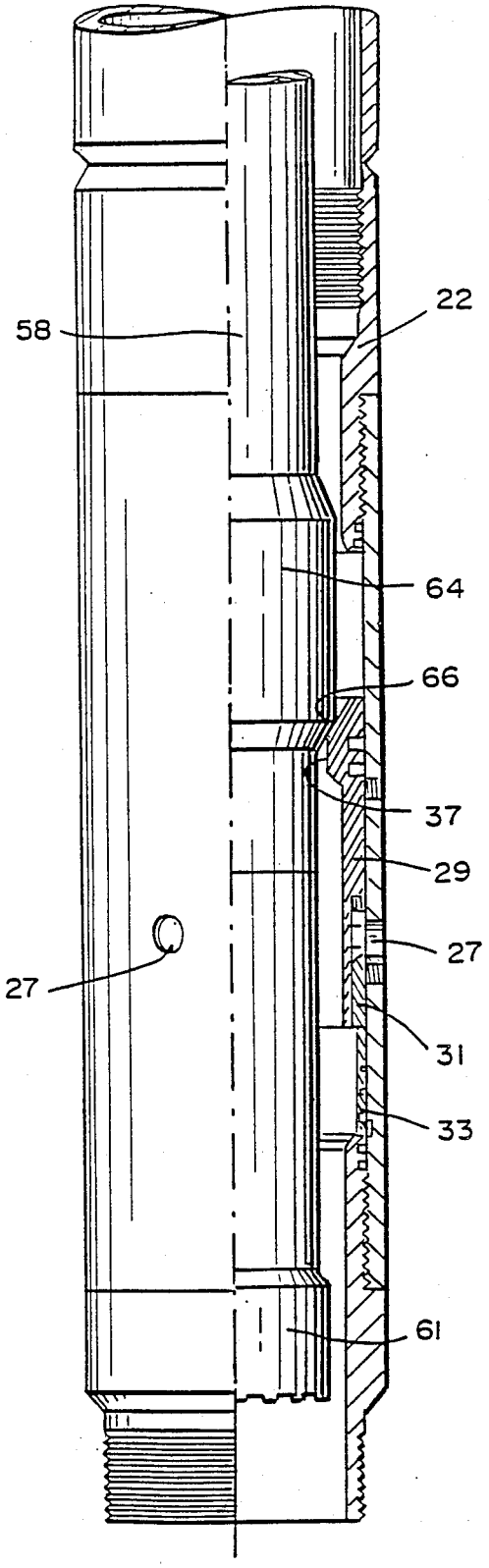
FIG. 6 is similar to FIG. 5.

As shown in FIG. 5, actuating tool 56 is comprised of a body section 57 having an upper end 58 adapted to removably couple with a drive shaft 59. The latter can be a pipe string, solid shaft or the like which supports the string. Pipe string can further incorporate such elements as stabilizers 69 which align the actuating tool body with the stage collar 14 inlet opening. Said pipe string can also include one or more drill collars, bumper subs, crossovers, and the like as required.

The actuating tool body 57 lower end is adapted to detachably accommodate a cutter or mill 61 having a lower, concave cutting face 62, as well as a peripheral cutting surface 63. Rotation of drive shaft 59 will cause cutter 61 to advance through both the cement mass in chamber 28, as well as through hub 44 of seaterd plug 41. The cutter will further enlarge the opening of annular shoulder 32 by cutting through a portion thereof to allow tool 56 passage therethrough. The action of cutter 61 will in effect form a cylindrical bore through the hardened cement in chamber 28.

Cutter 61 outer diameter, is such that as tool 56 is rotatably lowered; it is sufficiently narrow to cut away the seated upper plug 47 and transverse annular shoulder 37 without moving the upper sleeve segment 29. The latter, as noted, is not displaced into the advanced position to form a port closure.

The rear section of actuating tool body 57, spaced back from cutter 61, includes a hub 64. Said hub is formed with an annular face 71 which slidably engages the stage collar inner surface. Hub section 64 is further provided with an abutting shoulder or annular seat 66. Thus, as tool 56 is rotatably urged through casing 14, cutter 61 as it progresses downwardly, will sequentially mill away upper plug 57, an inner segment of annular shoulder 37. Further lowering of the rotating string will cause it to cut through hub 44 as well as a circular section of annular shoulder 32.

Removal of these otherwise blocking sections of the stage collar, will permit actuating tool 56 to be further lowered through the lower pipe string until the abutting face or annular seat 66 of hub 64, engages and overlaps the corresponding remaining segment of annular shoulder 37. Sleeve upper segment 31 will thus be urged downwardly into fully closed engagement with the lower sleeve segment 29 such that skirt 36 registers in annulus 37, forming a positive closure about the plurality of lateral discharge openings 27.

It is understood that although modifications and variations of the invention can be made without departing from the spirit and scope thereof, only such limitations should be imposed as are indicated in the appended claims.

We claim:

1. In a method for cementing a cased well, wherein a cementing staging collar forms an integral part of the well casing, said staging collar including:

a casing defining means forming a chamber having axially aligned inlet port and primary discharge port respectively for conducting a cement flow through said means forming said chamber, and a secondary discharge port in said casing between said inlet port and said primary discharge ports, a multi-segment sleeve operably retained in said means forming said chamber, one sleeve segment of said multi-segment sleeve being longitudinally dispalceable to affect a closure across said secondary discharge port to preclude cement flow therethrough, said casing having been at least partially cemented to the extent of substantially filling said means forming said chamber with hardenable cement, the improvement therein of providing a sleeve segment actuating tool—having at least one cutter means depending from the lower end thereof, and being engageable with means for rotating and advancing said sleeve segment actuating tool into the casing— concurrently rotating and advancing said sleeve segment actuating tool to erode a passage through hardened cement in the staging collar means forming said chamber, and contacting said one sleeve segment with said actuating tool to displace said sleeve segment into closed relationship with said secondary discharge port.

2. In the method as defined in claim 1, wherein said sleeve segment actuating tool includes:

at least one cutter means sufficiently wide to open a passage through cement in said chamber as well as through a portion of said one sleeve segment as the sleeve segment actuating tool is notably advanced through said means forming said chamber.

3. In the method as defined in claim 1, wherein said one sleeve segment is displaced longitudinally of said means forming said chamber, into engagement with a second sleeve segment of the multi-segment sleeve, and into closed relationship with said secondary discharge port.

* * * * *